United States Patent [19]

Rotella

[11] 4,431,222

[45] Feb. 14, 1984

[54] DISPOSABLE HAND OPERABLE COLLECTOR FOR ANIMAL EXCREMENT

[76] Inventor: Thomas B. Rotella, 22 E. 7th St., Clifton, N.J. 07011

[21] Appl. No.: 325,320

[22] Filed: Nov. 27, 1981

[51] Int. Cl.[3] ..... A47L 13/52

[52] U.S. Cl. ..... 294/1 B; 294/55

[58] Field of Search ..... 294/55, 1 B, 1 BA, 1 BB, 294/16, 25, 28, 106; 15/257.1, 257.6; 119/1 R; 229/3.5

[56] References Cited

U.S. PATENT DOCUMENTS

| | | | |
|---|---|---|---|
| 3,848,906 | 11/1974 | Fleishman | 294/1 B |
| 3,917,333 | 11/1975 | Grattan | 294/1 B |
| 4,188,055 | 2/1980 | Green | 294/1 B |

*Primary Examiner*—James B. Marbert

*Attorney, Agent, or Firm*—W. Patrick Quast

[57] ABSTRACT

There is disclosed a waste collector which is formed from a generally flat rectangular cardboard form. The form includes predetermined fold lines, including a first one, disposed longitudinally and centrally on the blank and other groups of lines which, when folded thereabout, form first and second cooperating jaw members. The collector is creased inwardly at the first fold line towards the volume enclosed by the cooperating jaw members. When finger pressure is applied transversely to the oppositely disposed longitudinal edges, this results in the first and second cooperating jaw members closing towards each other to retain the animal feces. A release of the applied finger pressure allows the jaw members to open. The oppositely disposed longitudinal edges include cutout sections which facilitate the movement of the jaw members towards and away from each other. Further, a locking strap is disclosed which is connected to one side of the inwardly directed crease and bridges the latter to retentively engage a longitudinally oriented slot such that the cooperating jaw members are retained in a locked or closed position after the release of the finger pressure.

2 Claims, 4 Drawing Figures

DISPOSABLE HAND OPERABLE COLLECTOR FOR ANIMAL EXCREMENT

BACKGROUND OF THE INVENTION

1. Field of the Invention

This invention relates generally to hand operable devices for scooping material and, more particularly, to a device which is suitable for the collection and retention of animal feces and litter for subsequent disposal.

2. Prior Art

The general public is continually annoyed and bothered by the presence of animal excrement on the community's streets, sidewalks, and grassy areas. The public in many towns has expressed this displeasure through the enactment of ordinances requiring animal owners to pick up after their pets. Of course, there are a conscious number of pet owners who, appreciating the hygienic problems and general inconveniences created by animal excrement, take it upon themselves to clean up after their animals.

Various devices have been developed over the years which attempt to solve this problem. These cover the gamut from the pet owner carrying a small shovel and broom to less cumbersome devices which are hand held and disposable. Many of the latter type, simple devices, are disclosed in such patents as U.S. Pat. Nos. 3,848,906; 3,857,597; 4,148,510; and 4,188,055. Generally, these prior devices have been found in practice to be relatively complicated or expensive to fabricate, difficult to use, or simply ineffective for the intended purpose.

One practical problem associated with these prior techniques is that many of them require the use of two hands. This virtually makes it impossible for a pet owner, having a medium or large size, active dog leashed to one hand, to collect the excrement. The dog must be tied to a stationary object first.

Those devices which are operable by using only one hand have been found to be limited in the amount of feces that can be collected at one time. Obviously, for a larger dog, a limited volume of such devices precludes their general usefulness. This typically results due of the fact that the operator's hand spans the volume encompassed by the collector. Conscious of this, the manufacturer must provide a device which can be gripped by the hand, eventually in a closed position, comfortably, but yet still provide sufficient volume to allow for collection of varying amounts of feces. Obviously, such a device does not have wide appeal, since it must accommodate varying hand sizes, including those of children.

Further, it is desirable for any such device to be able to be locked in a closed position once the feces has been collected, for ease of disposal.

Therefore, to provide a single-hand operated device with this additional capability imposes restrictions which heretofore have been difficult to meet.

Therefore, it is a primary object of this invention to provide a one-hand operated device for collecting animal excrement which also provides a means for locking the device once the feces material has been picked up. The actual locking of the device can be done with the same hand, thus allowing the put owner to maintain even an active animal on his leash.

It is yet another object of this invention to provide a relatively inexensive device fabricated from cardboard material and offered to the animal user in flat sheet form, but readily assembled into the finished device for use as the need arises.

It is still another object of this invention to provide a hand-held operable device which has generally greater volume than prior art devices, and thus useful with animals where it can be expected the excrement amount is excessive.

SUMMARY OF THE INVENTION

Towards the accomplishment of these and other objects which will become apparent from a study of the accompanying drawings and attending description, there is described a waste collector, said collector formed from a flat, generally rectangular paperboard form or the like, along predetermined fold lines, a first one of the fold lines disposed longitudinally and centrally on said blank. Other fold lines, include lines forming first and second, cooperating jaw members. When the blank is creased inwardly at the first fold line towards the volume enclosed by the formed cooperating jaw members, and then finger pressure applied transversely to the opposing longitudinally disposed edges, the cooperating jaw members are urged towards each other. A release of the applied finger pressure results in their movement away from each other. The oppositely disposed longitudinal edges include a cutout section centrally disposed along each edge to facilitate this movement of the jaw members towards and away from each other.

Further, the collector of the invention includes a locking strap member which is fixedly connected at one end to the form and bridges the inwardly directed crease which is centrally disposed on the form. The strap is designed to retentively engage a centrally disposed, longitudinally oriented slot, whereby said cooperating jaw members are locked together and remain so after the transversely applied pressure is released.

BRIEF DESCRIPTION OF THE DRAWINGS

In order to have a more complete understanding of the invention, reference is to be had to the accompanying drawings which illustrate an embodiment of the invention and are not to be construed as having any limitative intent.

IN THE DRAWINGS

Figure 1:
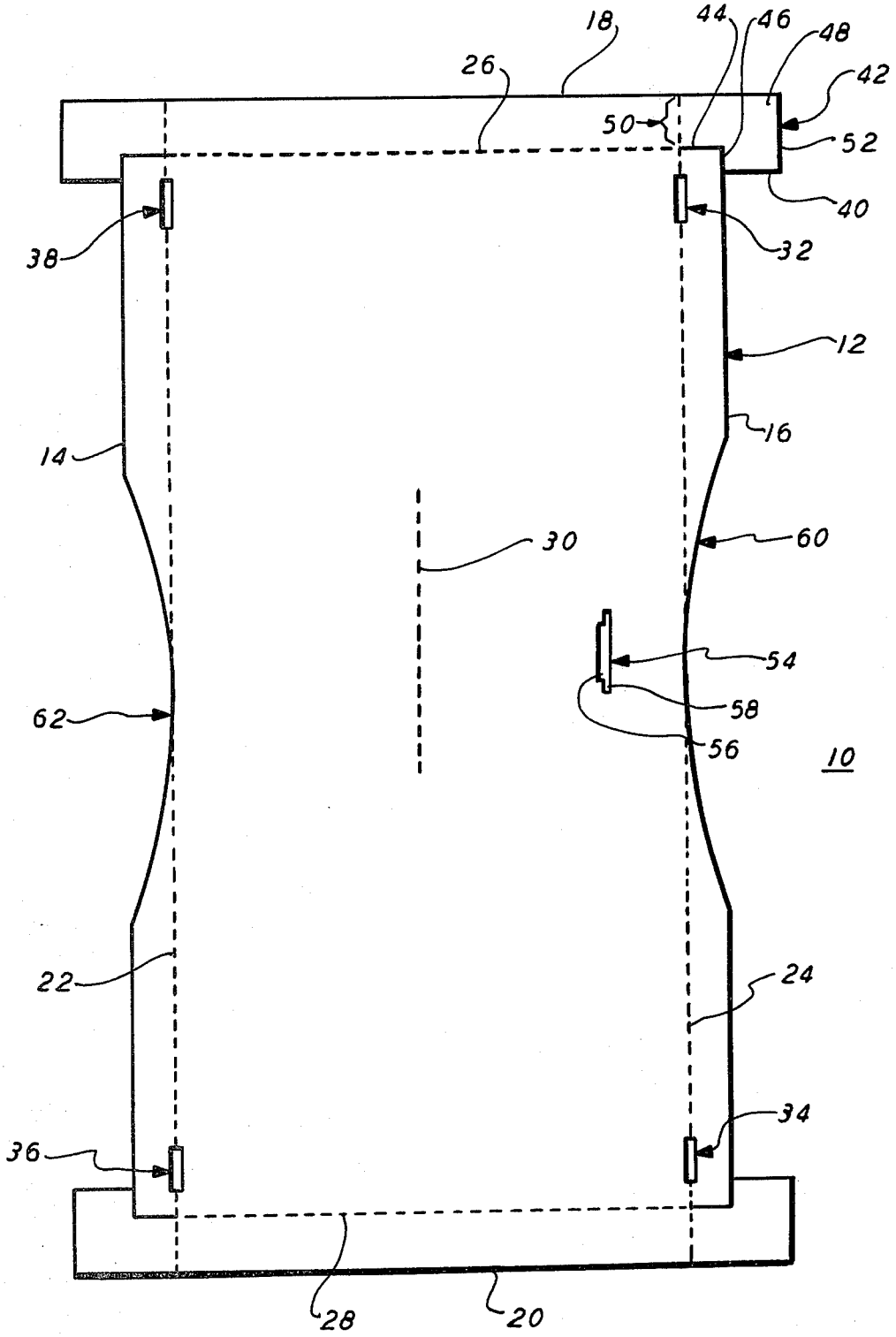

FIG. 1 is a plan view of the generally flat, rectangular paperboard form which is folded to form the collector of the present invention.

Figure 2:
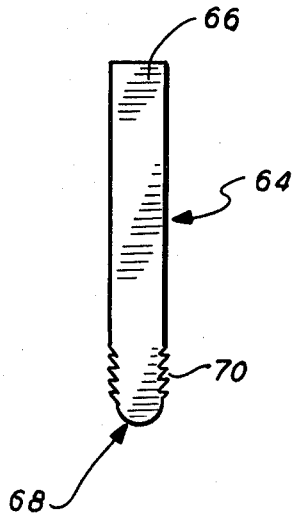

FIG. 2 is a plan view of a locking strap used in the form of FIG. 1.

Figure 3:
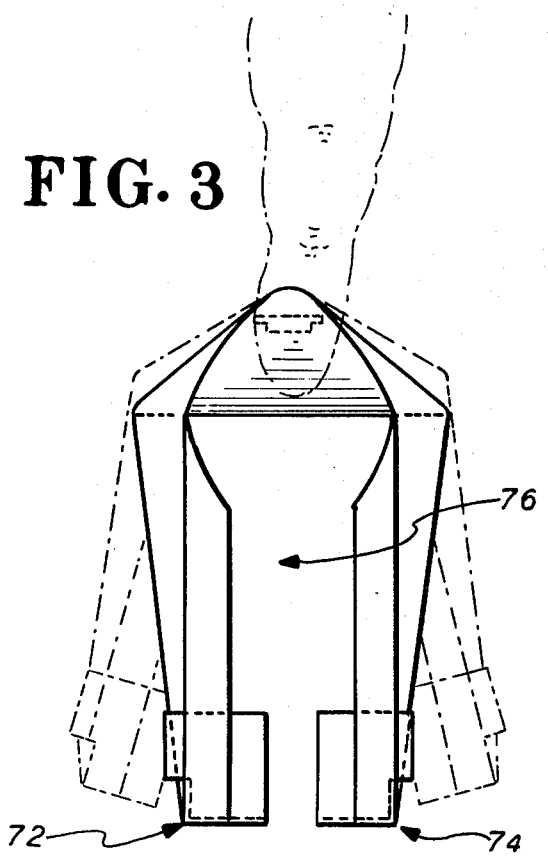

FIG. 3 shows the position of the formed collector as it moves between an opened and closed position in response to applied finger pressure.

Figure 4:
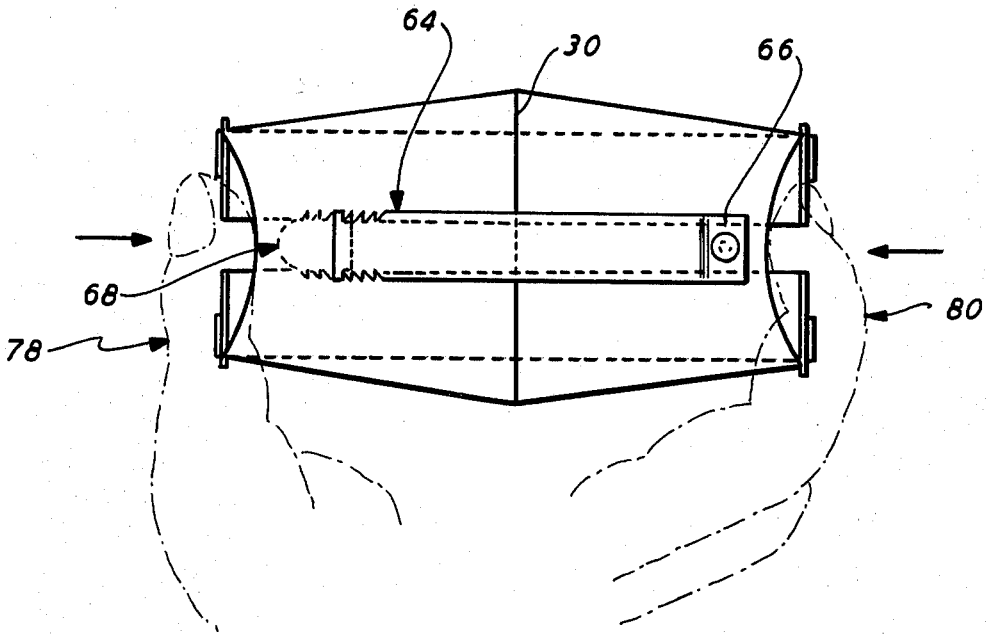

FIG. 4 is a top plan view showing the application of finger pressure to the longitudinal sides of the form.

DESCRIPTION OF THE PREFERRED EMBODIMENT

Referring now to FIG. 1, there is pictorialized the waste collector 10 of the present invention in its paperboard, blank form 12. Generally, the form, prior to formation into the collector, is rectangular in shape. It includes first and second longitudinal edges 14 and 16; and first and second end edges 18 and 20.

The form before folding is, typically, $8\frac{3}{4}$ inches in length between the end edges; and $4\frac{1}{2}$ inches between the longitudinal edges.

Inwardly disposed on the blank form from each of the longitudinal edges, approximately ¼ inch inboard, are first and second longitudinal fold lines, 22 and 24. Each runs the length of the form, from one end edge to the other.

Approximately ½ inch in from each of the first and second end edges are fold lines 26 and 28 which are transverse to the longitudinal access of the blank form.

Finally, a longitudinally disposed fold line 30, is centrally located on the blank between the opposing longitudinal edges.

In referring to the fold lines above, it is to be understood that these comprise either printed indicia disposed at the indicated locations, crease lines; or other suitable indicia or indentation to effect or direct the user to folding of the blank at these points into its final assembled arrangement.

Disposed near each of the corners in approximate location of the fold lines 22 and 24, are longitudinally extending slots, 32, 34, 36, and 38. These are of sufficient longitudinal length to accept the slot fitting edge 40 of a corresponding tab such as 42.

The tab referred to, looking at 42 as typical, is formed at each corner of the blank form 12. Edges 44 and 46, for example, are cut in the stock material of the tab 48 along the longitudinal edge 16 and the fold line 28. The cuts are made an appropriate length compatible with the proper alignment of the slot fitting edge 40 in slot 32. The tab in the assembly process would be folded along section 50 of fold line 24. Side edge 52 of the tab is approximately parallel to the longitudinal edge 16 and extends approximately ½ inch beyond the longitudinal edge 16.

The black form also includes a longitudinally oriented slot 54 which includes a narrow opening 56 and a wider opening 58. This slot is located half way between the end edges 18 and 20 and disposed approximately ½ inch in from the arcuate cutout section 60 of the longitudinal edge 16. Oppositely disposed on the longitudinal edge 14 is a similar arcuate cutout 62. Both of these cutouts, for the rectangular dimensions alluded to above, are such that their radius is approximately 5 inches.

Referring now to FIG. 2, there is depicted the locking strap 64 which is fastened to the blank form 12 by stapling end 66 at approximately equal distance from the longitudinal fold line 30 as is the retention slot 54. The opposite end 68 of the strap includes a serrated portion 70 which cooperates as described hereinafter with the narrow opening 56 to provide a locking means for the closed waste collector.

In assembling, the form is bent along the various fold lines to result in a usable waste collector. First of all, the tab sections such as 42 are folded at right angles about fold line section 50. When both tabs are thus formed at each edge, the edge section is folded along line 26 and 28 again, at right angles to the original plane of the form. With this fold, edges 42 for each tab now engage the corresponding slot such as 32. Once this edge has been inserted through the opening, the portion extending therebeyond is folded in order to retain the tab in engagement with the slot.

Thereafter, the portions of the form outboard of the longitudinally extending fold lines 22 and 24 are folded, again at right angles, such that there is an overlap of the folded section with the tabs. This is best seen in FIG. 3. Finally, in order to be able to have cooperating action between jaw members 72 and 74, user must crease the paperboard form along the centrally disposed longitudinal line 30. The crease is directed inward towards the volume 76 enclosed by the jaw members. Having done this, the user is now about to manipulate the collector by using his thumb and ringfinger 78 and 80 placed at the oppositely disposed arcuate cutout sections to effect a closing and opening of cooperating jaw members. Application of an inward directed finger pressure, as shown by the arrows in FIG. 4, results in a moving together of the cooperating jaw members to define the volume 76. A release of the finger pressure results in the jaw members opening up to the position shown in phantom in FIG. 3.

Once the user has collected the animal excrement into the volume 76 by the cooperating action of jaw members 72 and 74, the present device includes means for locking the jaws in a closed position so as to retain the feces. This locking results from the manipulation of the locking strap 64 by the index and/or middle finger of the user urging the end 68 into the wider opening 58 of the retention slot 54; thereafter, exerting a slight downward pressure in order to allow the serrated sides of end 68 to engage the narrower opening 56. When the finger pressure applied at the arcuate sections is then released, the strap bridging the creased line 30 affords a locking mechanism, keeping the jaw members closed. The collector can then be disposed of appropriately.

Various modifications to the collector as described herein above will be apparent in view of the disclosure. For example, the arcuate sections facilitate the opening and closing of the jaw members by eliminating the hindering portions of the longitudinal edge pieces in proximity to the center of the form. These longitudinal edge pieces formed between the fold line and the longitudinal edge could also be cut at the mid-point from the edge to the fold line with the edge section disposed on either side of that cut bent at slightly different angles to avoid interference between the two sections as the jaw members move between the open and closed positions.

Still further modifications can be made to the described embodiment without avoiding the breadth of the invention as set forth in the claims hereinafter.

What is claimed is:

1. A waste collector, said collector formed from a flat, generally rectangular paperboard form or the like along predetermined fold lines, a first one of said fold lines disposed halfway between the longitudinal edges of said blank, said first fold line extending longitudinally and centrally on said blank on either side of the midpoint between the end edges of said blank, others of said fold lines including lines forming first and second cooperating jaw members, said collector purposely creased inwardly at said first fold line towards the volume enclosed by said cooperating jaw members, whereby pressure applied transversely to the opposing longitudinally disposed edges, causes said first and second cooperating jaw members to close towards each other and a release of said applied pressure causing said jaw members to move away from each other, said paperboard form further includes a centrally disposed, longitudinally oriented slot inward from one of said longitudinal edges, said collector further comprising a locking strap having serrations along at least one edge thereof fixedly connected at one end to said form and bridging said inwardly directed crease and retentively engaging said slot through cooperative action between a respective serration and one of the edges defining the slot, whereby said cooperating jaw members are locked together and remain so after said pressure is released.

2. The collector claimed in claim 1 wherein the oppositely disposed, longitudinal edges each have an arcuate cutout section centrally disposed along each edge to facilitate the movement of said jaw members towards and away from each other.

* * * * *